United States Patent [19]

Polinko, Jr. et al.

[11] 4,158,911

[45] Jun. 26, 1979

[54] METHOD OF MANUFACTURING A VACUUM-TYPE CIRCUIT INTERRUPTER

[75] Inventors: George Polinko, Jr., Berlin, N.J.; Donald R. Kurtz, West Chester, Pa.

[73] Assignee: General Electric Company, Philadelphia, Pa.

[21] Appl. No.: 895,890

[22] Filed: Apr. 13, 1978

[51] Int. Cl.[2] ..... H01H 9/30

[52] U.S. Cl. ..... 29/622; 200/144 B

[58] Field of Search ..... 29/613, 622, 592; 174/140 R, 140 CR; 200/144 B; 219/221

[56] References Cited

U.S. PATENT DOCUMENTS

| | | | |
|---|---|---|---|
| 3,376,186 | 4/1968 | Douillard | 161/42 |
| 3,469,049 | 9/1969 | Crouch | 29/613 |
| 3,495,165 | 2/1970 | Cobine | 200/144 B |
| 4,063,991 | 12/1977 | Farrall | 200/144 B |
| 4,072,837 | 2/1978 | Crouch | 200/144 B |
| 4,079,217 | 3/1978 | Oeschger | 200/144 B |

*Primary Examiner*—C. W. Lanham
*Assistant Examiner*—Gene P. Crosby
*Attorney, Agent, or Firm*—William Freedman

[57] ABSTRACT

The following method is used for manufacturing a vacuum-type circuit interrupter that comprises: (i) an envelope comprising a glass casing and an annular metal disc imbedded in the glass and (ii) a tubular metal shield mounted on the disc. The shield is first located within the tubular casing and then fastened to said disc, thereby forming a shield-envelope subassembly. This subassembly is attached to the table of a vibrator. The vibrator is then operated to vibrate the subassembly, thereby producing between the glass casing and the shield force that acts to flex the disc, thus removing loosely-adhered glass particles from the disc. Then the subassembly is removed from the vibrator table, rinsed, and used in a conventional manner to complete the interrupter.

11 Claims, 8 Drawing Figures

METHOD OF MANUFACTURING A VACUUM-TYPE CIRCUIT INTERRUPTER

BACKGROUND

This invention relates to a method of manufacturing a vacuum-type circuit interrupter and, more particularly, relates to a method of manufacturing the interrupter so as to substantially reduce the number of free particles present within the interrupter during normal operation.

A widely-used type of vacuum interrupter comprises a centrifugally-cast tubular casing of glass and a metal disc cast into the glass and having an exposed portion projecting radially inward of the casing. This interrupter further comprises a tubular metal shield located within the tubular casing in radially-spaced relationship to the casing and mounted on the metal disc.

It has heretofore been recognized that the centrifugal casting operation usually leaves some glass on the disc that should be cleaned off during manufacture in order to avoid its subsequently being chipped off to produce loose particles during operation of the interrupter as a result of mechanical shocks incident to such operation. In U.S. Pat. No. 4,063,991—Farrall et al, assigned to the assignee of the present invention, it is proposed to clean off such residual glass by subjecting the disc first to a grit-blasting action and then to an etching action. This combination of steps does, in fact, significantly reduce the production of loose particles during operation of the interrupter, thereby improving the voltage withstand capabilities of the interrupter. It is advantageous to further improve the voltage withstand capabilities of the interrupter, and this, in fact, is a general object of our invention.

SUMMARY

Another object is to signficantly further reduce the number of loose particles developed in such an interrupter during its normal operation.

Still another object is to effect such reduction in the number of particles by a procedure that involves no additional chemical treatment or blasting action beyond that heretofore used.

In carrying out our invention in one form, we locate the above-described tubular metal shield within the glass casing and mount the shield on the exposed portion of the above-described disc, using for this purpose metal tabs on the shield which are positioned within and captured within suitable perforations provided in the disc. The glass casing of the resulting subassembly is attached to the vibratable table of a vibrator, following which the vibrator is operated to vibrate the table and the subassembly thereon. Such vibrations produce a force or loading between the shield and the glass casing that acts to slightly flex the disc and also to produce rubbing between the tabs and their associated perforations, and this action removes loosely-adhered glass particles from the disc and burrs from the tabs and the edges of the perforations. After this vibration action has been continued for a sufficiently long period to significantly reduce the chances of loose particles being produced during subsequent interrupter operation, the subassembly is removed from the table, following which it is rinsed to remove remaining loosely-adhered particles.

BRIEF DESCRIPTION OF DRAWINGS

For a better understanding of the invention, reference may be had to the accompanying drawings, wherein.

DETAILED DESCRIPTION OF PREFERRED EMBODIMENT

Figure 1:
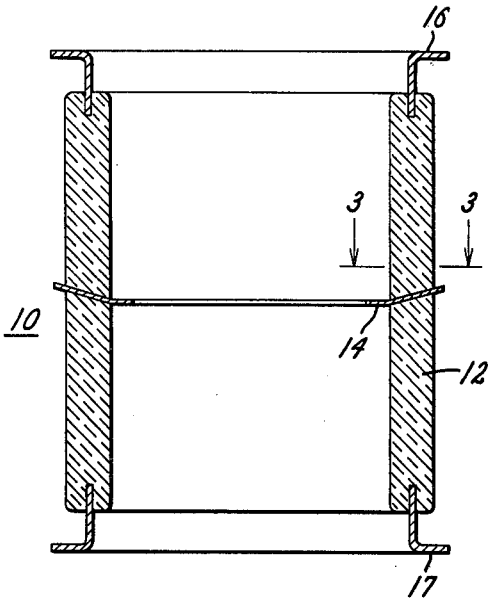
FIG. 1 is a cross-sectional view of the envelope of the vacuum interrupter.
Figure 2:
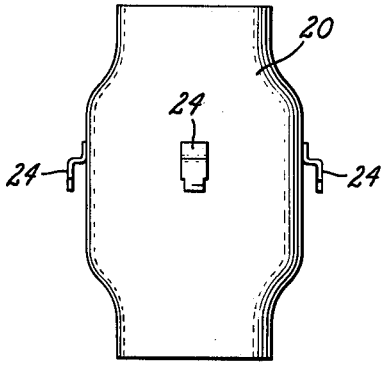
FIG. 2 is a cross-sectional view of the metal shield of the interrupter.
Figure 7:
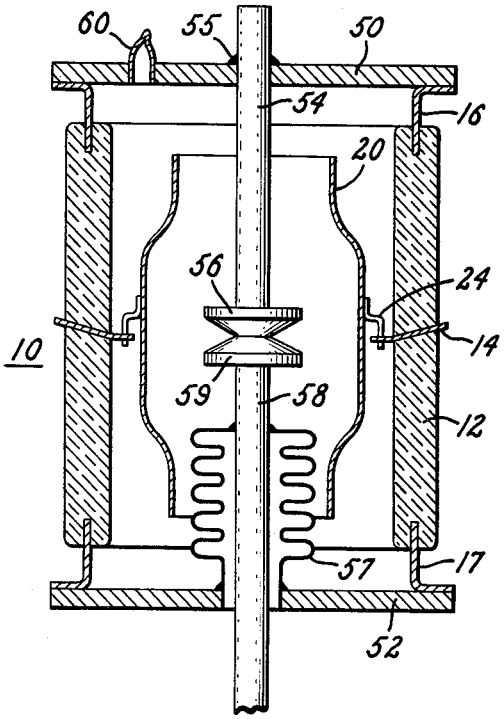
FIG. 7 is a sectional view of a completed vacuum interrupter made according to the method of this invention.

Referring first to FIG. 7, there is shown a conventional vacuum-type circuit interrupter comprising a highly evacuated envelope 10. This envelope, which is also depicted in FIG. 1, comprises a tubular glass casing 12, an annular metal disc, or mid-band, 14, imbedded within the glass of the casing, and two metal end rings 16 and 17 also imbedded within the glass. The envelope is preferably made by the centrifugal casting process diclosed and claimed in U.S. Pat. No. 3,376,186—Doulliard et al, assigned to the assignee of the present invention. The disc 14 and the end members 16 and 17 are imbedded within the glass of the casing during the casting process and while the glass is molten.

Joined to opposite ends of the envelope are two metal end caps 50 and 52. The upper end cap 50 carries a conductive contact rod 54 and a stationary contact 56 suitably joined to the lower end of the contact rod 54. The contact rod 54 extends through the upper end cap and is joined thereto by a vacuum-tight braze 55 surrounding the contact rod. The lower end cap 52 contains a central opening through which a lower contact rod 58 freely extends. A flexible metal bellows 57 provides a seal between lower contact rod 58 and end cap 52 that permits the lower contact rod to be moved vertically with respect to end cap 52. Suitably joined to the upper end of movable contact rod 52 is a movable contact 59 shown engaging the upper contact 56. When the contacts are engaged, the interrupter is in closed position.

Opening of the interrupter is effected by driving the movable contact rod 58 in a downward direction from its position of FIG. 1. This results in an arc being established between the contacts, and this arc persists until a natural current zero, at which time it is prevented from reigniting by the high dielectric strength of the vacuum in the envelope 10.

For condensing the arcing products so as to develop a high dielectric strength which prevents arc-reignition, a tubular metal shield 20 is provided. This shield is carried by the disc 14 in the envelope and is thus electrically isolated from both end caps 50 and 52 when the interrupter is open.

Figure 3:
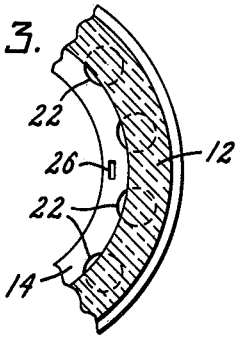
FIG. 3 is a sectional view along the line 3—3 of FIG. 1.

Referring next to the disc 14 for supporting shield 20, this disc contains a plurality of circumferentially-spaced holes 22 best shown in Fig. 3; and during the envelope-casting process these holes are almost completely filled with the molten glass, of the casing 12, thus firmly anchoring the disc within the casing when the glass solidifies upon cooling. The disc 14 and the end rings 16 and 17 are subject to a high temperature oxidation cycle prior to casting of the glass casing in order that the glass, upon solidifying, may readily and securely bond to the surface of these parts and form a vacuum-tight seal with their surfaces.

After the envelope 10 has been cast, it is removed from its mold. As can be seen in FIGS. 1 and 7, the disc 14 has an exposed annular portion extending radially inward from the cast glass casing, and this exposed portion is used in the completed interrupter for supporting the tubular metal shield 20. Following the casting operation, this exposed portion of disc 14 and the inner surface of the glass envelope are grit blasted, following which they are etched with a suitable etchant such as hydrofluoric acid, all as specifically disclosed and claimed in the aforesaid U.S. Pat. No. 4,063,991—Farrall et al. After the etching step, the envelope is thoroughly rinsed to removed any residual etchant, following which its interior is further cleaned in a conventional cleaning bath of chromic sulfuric solution and is then further rinsed. Prior to the above-described grit blast step, it is desirable to remove any large deposits of glass from the disc 14 by hand-filling, especially around the perforations 26.

Figure 6:
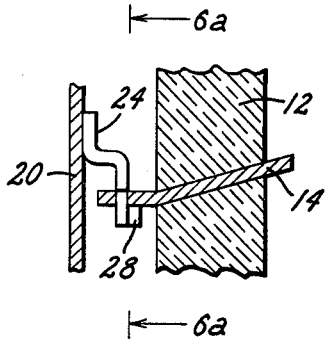
FIG. 6 is a sectional view along the line 6—6 of FIG. 5.
Figure 6A:
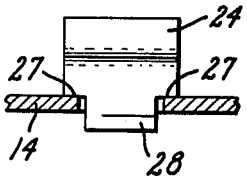
FIG. 6*a* is a sectional view along the line 6*a*—6*a* of FIG. 6.

Then the tubular metal shield 20 is inserted into the envelope and attached to the disc 14 through a plurality of circumferentially-spaced metal tabs 24 on the outer surface of the shield. In this connection, the exposed portion of disc 14 has a plurality of circumferentially-spaced slots 26 that are adapted to align with the tabs 24. When the tubular shield 20 is inserted into the casing 12, the free ends of the tabs 24 enter the slots 26, and shoulders 27 on the tabs rest on the portions of the disc 14 immediately adjacent the slots, as best seen in FIG. 6*a*. Then, integral clips 28 near the free ends of the tabs are deformed with a suitable tool, thereby capturing each tab within its associated slot.

Heretofore, the next step in the manufacturing operation was to join to the upper end of the envelope the sub-assembly comprising parts 50, 54 and 56 of FIG. 7 and to join to the lower end of the envelope the sub-assembly comprising parts 52, 57, 58 and 59.

Figure 4:
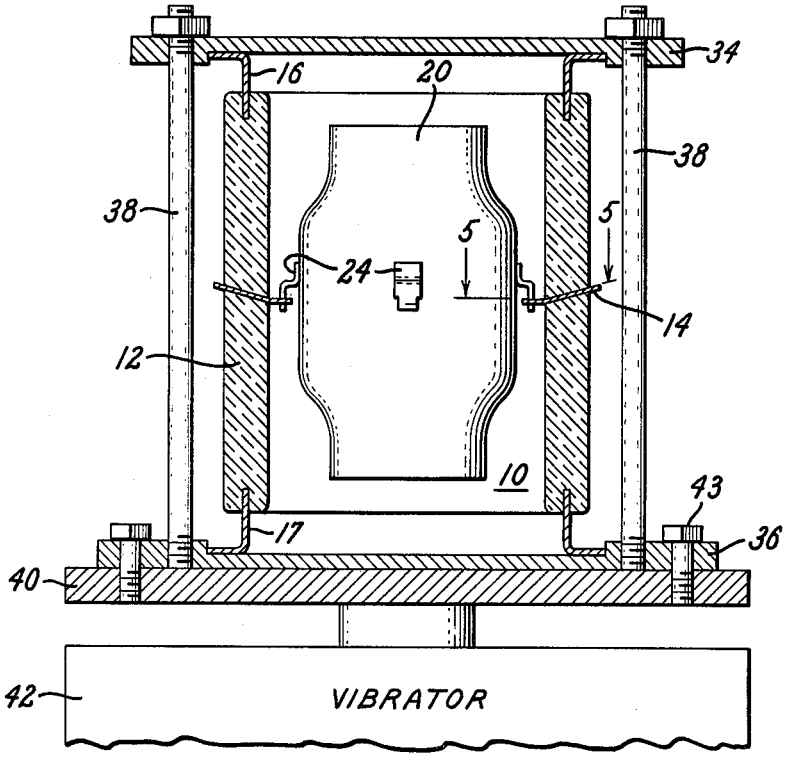
FIG. 4 shows the shield of FIG. 2 assembled within the envelope of FIG. 1 and the envelope attached to the table of a vibrator.
Figure 5:
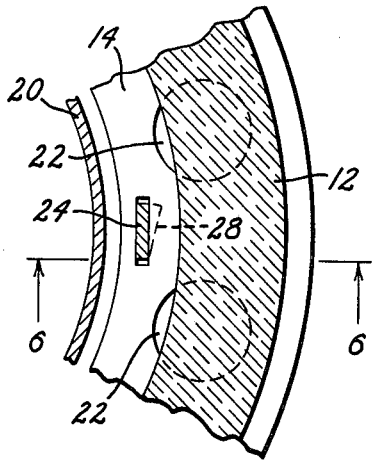
FIG. 5 is an enlarged sectional view along the line 5—5 of FIG. 4.

In carrying out our invention in one form, however, we introduce, prior to the step of the immediately-preceding paragraph, certain additional steps which will now be described. Referring to FIG. 4, we clamp the sub-assembly comprising the envelope 10 and shield 20 between two fixture members 34 and 36 at opposite ends of the envelope. A plurality of circumferentially-spaced studs 38 are used for forcing these fixture members 34 and 36 together and against opposite ends of the envelope. Then one of the fixture members is attached to the vibratable table 40 of a conventional vibrator 42, preferably through use of screws 43.

The vibrator is then operated, thus vibrating the table 40 and the sub-assembly 10, 20 attached thereto. These vibrations produce force between the shield 20 and the glass casing 12 that acts to slightly flex the disc and also to produce rubbing betweem the tabs and their associated perforations. This action removes loosely-adhered glass particles and also removes burrs from the tabs and the surrounding edges of the perforations. The removed particles fall onto the lower end fixture.

This vibrating action is continued for a sufficient length of time to significantly reduce the chances of loose particles being generated by mechanical shocks during subsequent interrupter operation. In one embodiment of the invention, we continue the vibrating action for approximately 5 minutes. In arriving at this time interval, we experimented with continuing the vibrations for several minutes past the 5 minute limit and found that no significantly amount of additional particles fell onto the lower end fixture in response to such additional vibrations. Ideally, the vibrating action is continued for a sufficient time to remove substantially all the particles that could be broken loose from the disc 14 or the tabs as a result of mechanical shocks during the entire expected life of the interrupter.

In a preferred form of the invention, we vibrate the table 40 of the vibrator at a frequency of about 55 cycles per second and an amplitude ⅛ inch during most of the vibration period. The table is brought up to this frequency from an at-rest condition over a period of about 30 seconds and is brought to rest over a similar time interval.

After the vibrating action has been completed, the composite fixture 34, 36, 38 with the sub-assembly 10, 20 clamped therein is removed from the table 40, following which the upper fixture member 34 is removed and the sub-assembly 10, 20 if lifted out of the fixture. During those removal steps, the sub-assembly 10, 20 is maintained in an upright position so that the shaken-loose particles that had fallen to the lower fixture member 36 remain thereon.

Any residual loose particles remaining on the assembly 10, 20 are then removed by a rinsing step, such as subjecting the assembly to a jet of argon or dry nitrogen, which blows off such particles. As an alternative, we can use a jet of distilled and deionized water for this rinsing step; or as another alternative, we can immerse the sub-assembly in a bath of distilled and deionized water containing an ultrasonic wave generator. This latter procedure is popularly referred to as an ultrasonic rinse and, when used, is followed by blowing the inside of the sub-assembly dry with argon or dry nitrogen.

After the sub-assembly 10, 20 has thus been treated, the upper end cap 50 (with parts 54 and 56 attached) is suitably brazed to the upper end ring 16, and the lower end cap 52 (with parts 56, 57, and 59 attached) is suitably brazed to the lower end ring 17. The resulting capped envelope is then baked-out and evacuated through an exhaust tube 60, following which the tube 60 is pinched off to seal the evacuated assembly, all in a conventional manner.

As an indication of the improved voltage withstand capabilities of interrupters that have been subjected to the vibration step of our invention, reference may be had to the following capacitance switching tests, which were conducted on a total of six interrupters at 44 kV single phase test voltage and 500 amperes. All the tested interrupters were in an essentially new condition at the start of the tests. The tested interrupters were of essentially the same design and were made by the same method as described hereinabove except that the method used for some of the interrupters omitted the above-described vibration step. A first group consisting of two interrupters that had not been subjected to the vibration step showed an average restrike rate of more than 3.5% in a total of 131 capacitance switching operations. A second group consisting of four interrupters which had been vibrated as above described during their manufacture showed a restrike rate of less than 0.5% in a total of 403 capacitance switching operations.

This represents an improvement in restrike, or breakdown, rate of greater than 7 times when the interrupters were made using our above-described vibration operation.

While we prefer to join the shield 20 to the disc 14 by use of tabs on the shield captured within perforations in the disc, it is to be understood that the invention in its broader aspects is intended to comprehend the use of other suitable types of fastening means for fastening the shield to the disc (e.g., tabs on the shield spot welded to the disc).

In the above-described vibration step, as actually practiced, the vibrations of the table 40 and the attached envelope 10 were along an axis extending generally parallel to the longitudinal axis of the tubular casing 12, i.e., in the Y direction. It is to be understood, however, that the vibrations need not be confined to a single axis but could have components in the X and Z directions, i.e., orthogonal to the Y direction, as well as in the Y direction. It is important, however, that there be at least a component in the Y direction so as to assure flexing of the disc 14 during the vibrations.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

We claim:

1. In a method of manufacturing a vacuum-type circuit interrupter that comprises: (i) an envelope comprising a tubular casing of glass and an annular metal disc imbedded in said glass and having an exposed portion projecting radially inwardly from said casing and containing circumferentially-spaced perforations, and (ii) a tubular metal shield having metal tabs attached to its outer surface; the steps of:

(a) locating said shield within said tubular casing and mounting the shield on said disc by positioning and capturing said tabs within said perforations, thereby forming a shield-envelope subassembly, (b) attaching the envelope portion of said assembled subassembly to the vibratable table of a vibrator, (c) operating said vibrator to vibrate said table and said subassembly thereon, thereby producing between said tubular glass casing and said shield force that acts to flex said disc and also to produce rubbing between said tabs and the edges of their associated perforations, thus removing loosely-adhered glass particles from said disc and burrs, if present, from said disc and tabs, (d) removing said subassembly from said table, (e) and then rinsing from said subassembly remaining loosely-adhered particles.

2. The method of claim 1 in which said vibrating action is continued sufficiently long so that if the subassembly is tested by subjecting it to several additional minutes of vibration at the frequencies and amplitudes used in step (c) of claim 1, no significant additional quantity of particles fall off said subassembly.

3. The method of claim 1 in which said vibrating action is continued for a sufficiently long period that vibrations near the end of said period cause no significant additional quantity of particles to fall off said subassembly.

4. The method of claim 3 in which said vibrating action is continued for at least about five minutes.

5. In a method of manufacturing a vacuum-type circuit interrupter that comprises: (i) an envelope comprising a tubular casing of glass and an annular metal disc imbedded in said glass and having an exposed portion projecting radially inwardly from said casing, and (ii) a tubular metal shield mounted on said disc; the steps of:

(a) locating said shield within said tubular casing and fastening the shield to said disc in radially-spaced relationship to said glass casing, thereby forming a shield-envelope subassembly, (b) attaching the envelope portion of said assembled subassembly to the vibratable table of a vibrator, (c) operating said vibrator to vibrate said table and said subassembly thereon, thereby producing between said tubular glass casing and said shield force that acts to flex said disc, thus removing loosely-adhered glass particles from said disc, (d) removing said subassembly from said table, (e) and then rinsing from said subassembly remaining loosely-adhered particles.

6. The method of claim 5 in which said vibrating action is continued sufficiently long so that if the subassembly is tested by subjecting it to several additional minutes of vibration at the frequencies and amplitudes used in step (c) of claim 5, no significant additional quantity of particles fall off said subassembly.

7. The method of claim 5 in which said vibrating action is continued for a sufficiently long period that vibrations near the end of said period cause no significant additional quantity of particles to fall off said subassembly.

8. The method of claim 5 in combination with the additional steps of:

(a) joining end caps to opposite ends of said envelope after step (e) of claim 5, thereby forming a capped envelope, and (b) baking-out and evacuating said capped envelope.

9. The method of claim 5 in which the steps recited in claim 5 are preceded by the steps of:

(a) blasting the interior of said envelope, including the exposed portion of said disc, with gas-propelled grit, and (b) etching the interior of said envelope, including the exposed portion of said disc, to remove loose glass particles and glass on said exposed portion.

10. The method of claim 1 or 5 in which said envelope is attached to said table by clamping said envelope between two fixture members located at its opposite ends and attaching one of said fixture members to said table.

11. The method of claim 1 or 5 in which said vibrating action is continued for a sufficiently long period to significantly reduce the chances of loose particles being produced during subsequent interrupter operation.

* * * * *